United States Patent [19]

Zankich

[11] 4,341,407

[45] Jul. 27, 1982

[54] ADJUSTABLE RETENTION LATCH ASSEMBLY

[75] Inventor: Frank A. Zankich, San Pedro, Calif.

[73] Assignee: Rexnord Inc., Milwaukee, Mich.

[21] Appl. No.: 148,110

[22] Filed: May 9, 1980

[51] Int. Cl.[3] ..... E05C 5/00

[52] U.S. Cl. ..... 292/111; 292/215

[58] Field of Search ..... 292/110, 111, 112, 113, 292/215, 216

[56] References Cited

U.S. PATENT DOCUMENTS

| | | | |
|---|---|---|---|
| 1,412,630 | 4/1922 | Richard | 248/284 X |
| 1,786,011 | 12/1930 | Groenenstein | 248/293 X |
| 2,328,216 | 8/1943 | Joachim | 292/110 |
| 2,339,537 | 1/1944 | Wise | 292/110 |
| 2,939,734 | 6/1960 | Claud-Mantle | 292/112 X |

FOREIGN PATENT DOCUMENTS

| | | | |
|---|---|---|---|
| 854885 | 11/1960 | United Kingdom | 248/475 B |

*Primary Examiner*—J. Franklin Foss

*Attorney, Agent, or Firm*—Vance V. Smith; Raymond E. Fritz; Robert H. Kelly

[57] ABSTRACT

A latch assembly for aligning the holes in a panel and a frame such as those used in aircraft doors. The assembly includes a hook for engagement with a striker to retain the panel and a sliding hook mechanism to align the holes. The sliding hook mechanism is operated by a camming means to urge the hook toward or away from the striker to bring the holes into alignment thereby preventing damage to the fastener and freeing both hands of a workman to secure or release the fasteners.

8 Claims, 8 Drawing Figures

ADJUSTABLE RETENTION LATCH ASSEMBLY

BACKGROUND OF THE INVENTION

The present invention relates to latch assemblies and more particularly to an adjustable retention latch assembly used to provide temporary retention and alignment of a heavy object, such as an aircraft door, that is to be secured with fasteners.

Many aircraft doors have relatively severe curvatures and are hinged at one end so that the door may be opened and closed with a swinging motion away from or toward the end that is not hinged. The door is secured using threaded panel fasteners inserted through holes in the door panel which threadably engage nuts mounted on the frame to which the door is attached. It is highly desirable to align the holes in the door with their respective nuts before attempting to secure the panel fasteners to avoid damaging the threads of the fasteners. Likewise, maintaining alignment of the door panel is preferred when unfastening it to minimize damaging or even breaking the panel fasteners. The possibility of damage is enhanced if the door panels are heavy. Typically, workman attempts to align the holes in the door panel with their respective nuts by holding the door in position with one hand while securing the panel fasteners with the other. When such a door is quite heavy or if there is a seal between the door and the frame, as is often the case, alignment is extremely difficult and quite often impossible. The difficulty encountered is even greater if the door is positioned in such a manner as to be swung open toward the ground. In order to secure or remove the fasteners, the door must be held in an upward position against the force of gravity. This is often the case with aircraft doors placed on the underside of aircraft.

The adjustable retention latch assembly of the present invention solves the foregoing problems by providing a means for aligning the holes in the door panel with their respective receptacles or nuts, and retaining the door in such aligned position, thereby freeing the hands of a workman to install or remove the threaded panel fasteners without damaging the fasteners or harming himself due to the weight of the swinging door.

SUMMARY OF THE INVENTION

The adjustable retention latch assembly of the present invention includes a striker and a hook mechanism. The striker, comprising a crosspin positioned in an adjustable mounting, is attached to the frame of an aircraft near the opening to be closed by a door. The mounting preferably has slotted holes to provide flexibility in positioning the striker relative to the hook mechanism for gross door adjustment.

The hook mechanism comprises a hook for engagement with the striker mounted on a bracket to provide pivotal movement of the hook toward or away from the striker. The hook mechanism also includes a spring biasing the hook toward the striker. There is also provided a slide for urging the hook mechanism toward or away from the striker mounted on the bracket and connected to the hook. An adjustment means is connected to the bracket and engages the slide to move the slide in response to its operation.

The adjustment means disclosed herein, includes a camming means comprising a rotatable cylinder on the underside of the slide with an eccentric portion extending through a slot in the slide. The slide and the hook can be moved toward or away from the striker by rotating the cylinder with a tool inserted in a receptacle in the cylinder from the underside of the hook mechanism accessible from the exterior of the door onto which the bracket is mounted.

The adjustable retention latch assembly also preferably includes a locking means for restricting movement of the cylinder to prevent unintentional slipping of the hook mechanism. The locking means shown comprises two spherical balls positioned in a transverse bore in the cylinder. The balls are urged outwardly by a spring positioned between the balls to frictionally engage the bracket thereby preventing unintentional movement of the cylinder.

It will be noted that gross alignment and retention of the door panel is accomplished by engagement of the hook with the striker and final alignment of the holes in the door with their respective nuts attached to the frame is accomplished by appropriately adjusting the camming means to urge the hook mechanism away from the striker after the hook has been engaged to draw the door and frame together.

DETAILED DESCRIPTION OF THE PREFERRED EMBODIMENT

Figure 2:
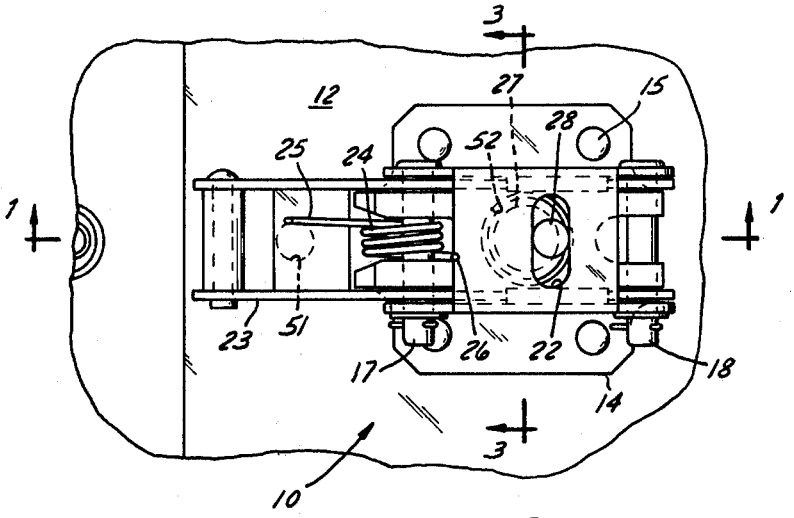
FIG. 2 is a plan view of the hook mechanism of FIG. 1.
Figure 1:
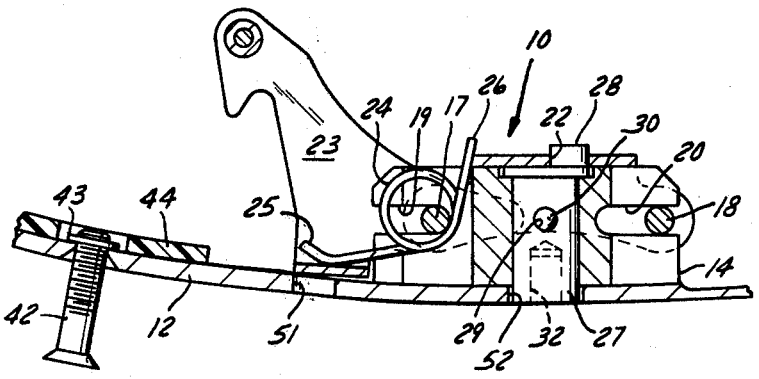
FIG. 1 is a side elevational view of the hook mechanism of the present invention attached to a door panel.

Referring now to FIGS. 1–4, there is shown a hook mechanism 10 constructed in accordance with the principles of the present invention. The hook mechanism 10 is shown attached to an aircraft door panel 12 although, as previously stated, it is to be understood that the present invention may be utilized with other types of panels.

The hook mechanism 10 comprises a bracket 14 with mounting holes 15 in its base through which rivets 16 or other means may be inserted to attach the bracket 14 to the panel 12. Typically the hook mechanism 10 is located on the panel 12 near the edge to be secured, i.e. the edge which is farthest from the panel door hinges. The bracket 14 has first and second crosspin 17, 18 positioned at the forward and rear portions of the bracket 14. The holes 19, 20 in the bracket 14 through which the crosspins 17, 18 pass are elongated to allow movement of the slide 21 relative to the bracket 14 as will be further discussed.

A hook 23 is loosely connected to the forward edge of the bracket 14 by attaching it to the first crosspin 17 to provide relative ease of motion of the hook 23 on the crosspin 17. There is also a spring 24 located on the bracket 14 which biases the hook 23 away from the bracket 14 and toward a striker. One tail 25 of the coil spring 24 shown rests on the hook 23 while the other tail 26 is supported by the slide 21 that is also connected to the crosspins 17, 18 mounted on the bracket 14 and capable of moving relative to the bracket 14.

Figure 3:
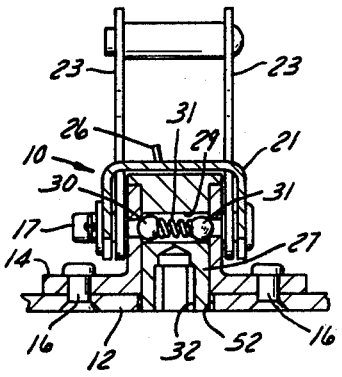
FIG. 3 is a rear view of the hook mechanism of FIG. 1.
Figure 4:
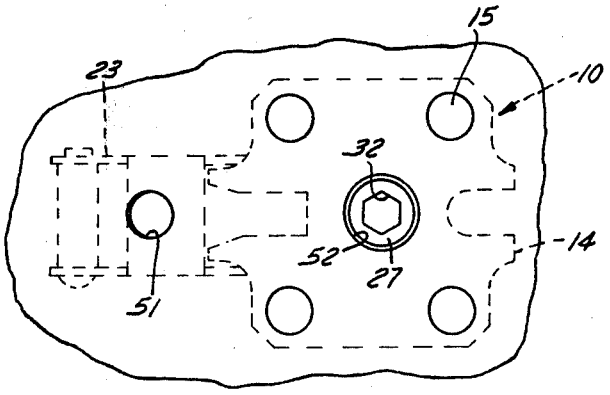
FIG. 4 is a view showing the underside of the hook mechanism of the present invention as seen from the exterior of the door panel on which it is mounted.

As is best seen in FIG. 3, the slide 21 comprises an inverted generally U-shaped member located on the upper portion of the bracket 14. In the upper surface of the slide there is an elongated slot 22 through which passes the protruding portion 28 of a cylindrical member 27 also connected to the bracket 14.

The cylindrical member 27 is part of the camming means employed to move the slide 21 relative to the bracket 14. The cylindrical member 27 is generally centrally located in the bracket 14 extending beneath the bracket 14 a sufficient amount to also fit into an appropriately located hole 52 in the door panel 12 so that access to the drive slot 32 in the cylindrical member 27 may be achieved from outside the panel 12 with an appropriate tool.

The cylindrical member 27 has a transverse bore 29 in which are located two spherical members 30 separated and urged outwardly by a spring 31 to provide a means for maintaining the position of the cylindrical member 27 thereby restricting unintentional rotation of it. As shown in FIG. 3 portions of the spherical members 30 are in frictional engagement with the bracket 14 to provide the restriction of rotation.

The hook mechanism 10 is adapted to engage a striker 33 mounted on the frame 38 to which the panel 12 is secured. The striker 33 shown in FIGS. 5–8 includes a crosspin 34 for engagement by the hook 23 which is connected to a bracket 14 with cotter pins 36 in a conventional manner. The mounting holes 37 in the striker bracket 35 are preferably elongated to form slots 37 that allow displacement of the striker 33 relative to the hook 23 for facilitating installation of the latch assembly 10 by providing a means for gross adjustment of the assembly 10. The striker bracket 35 may be attached to the frame 38 in any conventional manner such as the bolt 39 and nut 40 shown.

Also mounted on the frame 38 is a nut 41 to which the fastener 42 is secured. It is often desirable to provide a retainer ring 43 on the fastener 42 to prevent total removal of the fastener 42 from the panel 12. In the embodiment shown there is also a seal 44 attached to the panel 12 which is sometimes used to provide a tighter fit between the panel 12 and frame 38.

Figure 5:
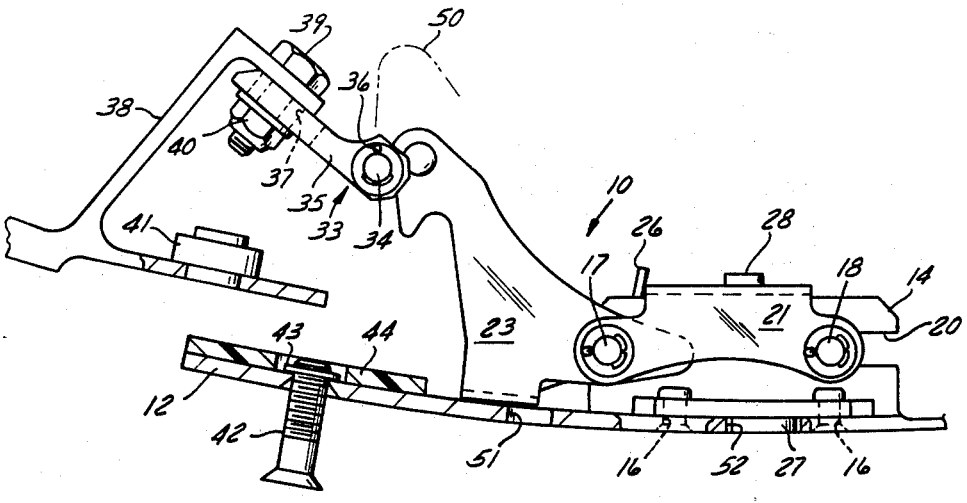
FIG. 5 is a side elevational view of the adjustable retention latch assembly of the present invention including the striker.
Figure 6:
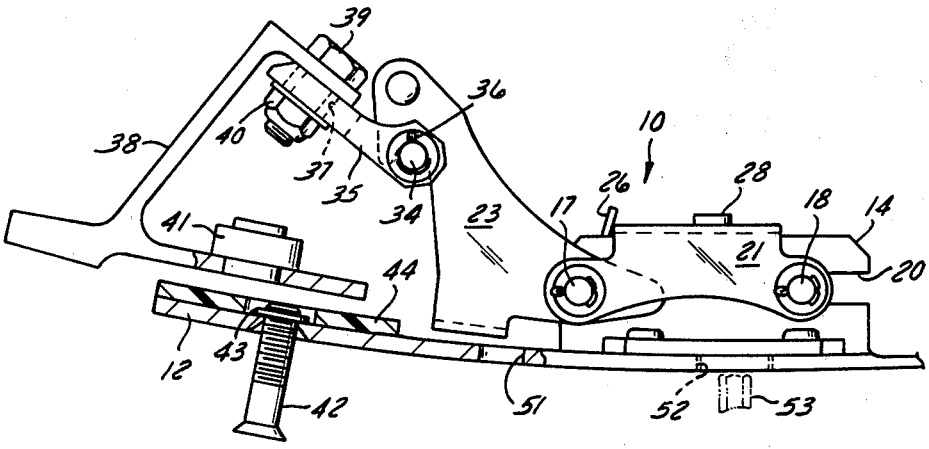
FIG. 6 is a side elevational view of the adjustable retention latch assembly of FIG. 5 with the hook engaging the striker prior to final alignment with a camming tool.
Figure 7:
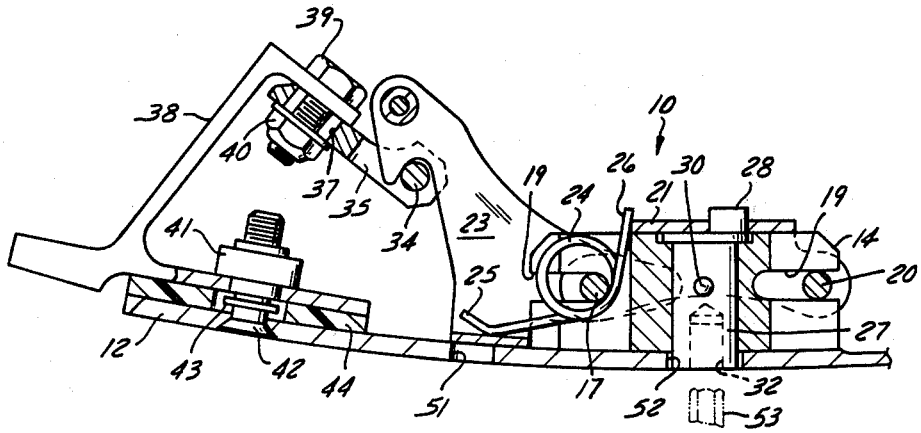
FIG. 7 is a side elevational view of the adjustable retention latch assembly of the present invention after final alignment has been made and the camming tool is removed.

In order to secure the fastener 42, the panel 12 is typically pushed by hand toward the frame 38. As shown in FIG. 5, when this occurs, the hook 23 contacts the striker 33 and slides along it, as represented by the phantom line 50, until the hook 23 rides over the striker 33 to retain the panel 12 in the position as shown in FIG. 6. It is to be noted that the hook 23 provides retention of the panel 12 to allow further alignment of the fastener 42 in the panel 12 and the nut 41 in the frame 38. At this point, both of a workman's hands are available to align and then secure the fastener 42.

Once the hook 23 engages the striker 33, alignment of the fastener 42 and its associated nut 41 is accomplished by operation of the camming means. In the embodiment shown, the cylindrical member 27 has a conventional hex hole 32 into which a standard tool, such as an allen wrench 53, can be positioned to operate the camming means. It should be noted, however, that other forms of slots could be used in conjunction with other tools without departing from the principles of the present invention. Final alignment is provided by rotating the cylindrical member 27 thereby moving the slide 21 along the bracket 14 in an attempt to move the hook 23 away from the striker 33. Since the hook 23 is in engagement with the striker 33, the frame 38 and panel 12 will be drawn together to properly align the fastener 42 and nut 41. When alignment is achieved, it is maintained by frictional engagement of the outwardly disposed spherical members 30 with the bracket 14 preventing rotation of the cylindrical member 27 and therefore movement of the hook mechanism 10, so the fastener 42 can be secured without damaging it or the nut 41.

Figure 8:
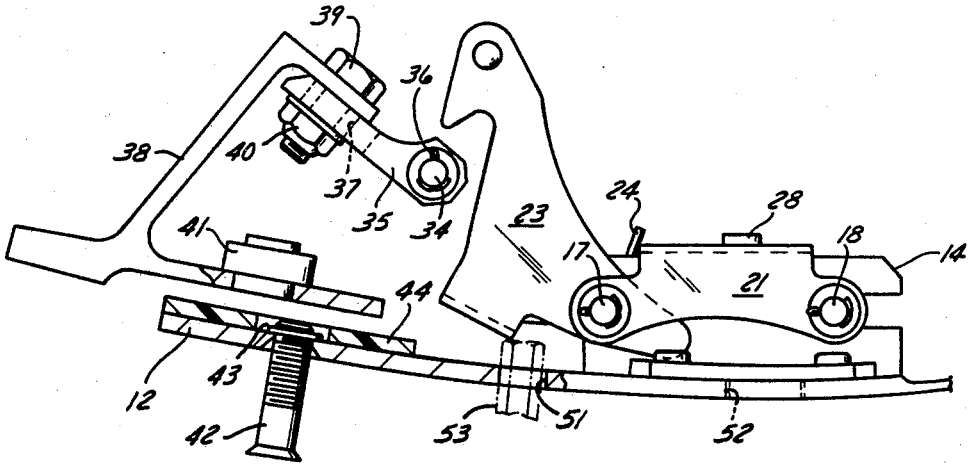
FIG. 8 is a side elevational view of the adjustable retention latch assembly constructed according to the principles of the present invention showing the camming tool used to disengage the hook mechanism to open the door panel.

Similarly, the panel door 12 may be opened by first loosening the fasteners 42 while the hook mechanism 10 holds the panel 12 in place allowing all fasteners 42 to be loosened without damaging them and without requiring a workman to hold the panel 12 in place. After all fasteners 42 are loosened and retracted, door panel 12 is moved away from frame 38 by rotating cylindrical member 27 with tool 53. The workman, while supporting the panel 12, can then disengage the hooks 23 by inserting the tool 53 in the panel hole 51 under the hook 23 as shown in FIG. 8 and then open the door panel 12.

While the adjustable retention latch assembly of the present invention has been described with reference to the particular embodiment disclosed herein, changes and variations may be made by those skilled in the art without departing from the scope of the invention as defined by the following claims:

I claim:

1. An adjustable retention latch assembly comprising: a striker, a hook releasably engagable with said striker, a bracket onto which said hook is mounted, a slide mounted on said bracket and connected to said hook, adjustment means for moving said slide toward or away from said striker, said adjustment means including a cylindrical member engaged with said slide for moving said slide in response to rotation of said cylindrical member, and retention means for preventing unintentional rotation of said cylindrical member, said slide including a base, legs depending from said base and attached to said hook, said base having a slot therein, and said cylindrical member including an eccentric extended portion passing through said slot, said cylindrical member having a receptacle therein for rotation thereof upon insertion and rotation of a tool.

2. An adjustable retention latch assembly comprising: a striker, a bracket including a base and two leg portions upwardly extending from said base; said legs having two pairs of elongated slots therein extending in the direction of said striker, first and second crosspins each extending through a pair of said slots, a hook connected to said first crosspin for pivotal movement thereon to releasably engage said striker, a slide comprising a base and two legs depending from said base; said slide connected to said crosspins for movement along said bracket toward or away from said striker, and adjustment means engageable with said slide for moving said slide toward or away from said striker.

3. An adjustable retention latch assembly as defined in claim 2 wherein the base of said slide has a slot therein and said adjustment means comprises a cylindrical member mounted on said bracket, an eccentric extended portion connected to said cylindrical member and passing through said slot, said cylindrical member having a receptacle therein for rotation thereof upon insertion and rotation of a tool.

4. An adjustable retention latch assembly as defined in claim 3 further conprising a spring mounted on said first crosspin to bias said hook toward said striker.

5. An adjustable retention latch assembly as defined in claim 3 or 4 further comprising retention means including said cylindrical member having a transverse bore therein, two spherical members within said bore, and a spring between said spherical members for urging said spherical members outwardly to frictionally engage said bracket.

6. An adjustable retention latch assembly for an aircraft door panel to align the fasteners in the door panel with their respective nuts comprising: a striker mounted on said frame, and a hook mechanism mounted on said door panel; said hook mechanism comprising a bracket including a base connected to said door panel, two legs extending from said base; said legs having two pairs of elongated slots therein extending in the direction of said striker, first and second crosspins each positioned through a pair of said slots, a hook connected to said first crosspins for pivotal movement thereon to releasably engage said striker, a slide comprising a base and two legs depending from said base; said slide connected to said crosspins for movement along said bracket toward or away from said striker, the base of said slide having a slot therein, a cylindrical member mounted on said bracket; said cylindrical member having an eccentric extended portion thereof passing through said slot, said cylindrical member having a receptacle therein for rotation thereof upon insertion and rotation of a tool, said receptacle being accessible from outside the door panel.

7. An adjustable retention latch assembly as defined in claim 6 further comprising retention means including said cylindrical member having a transverse bore therein, two spherical members within said bore, and a spring between said spherical members for urging said spherical members outwardly to frictionally engage said bracket.

8. An adjustable retention latch assembly as defined in claim 6 or 7 further comprising a spring mounted on said first crosspin to bias said hook toward said striker and said door panel has a hole therein through which a tool may be used to pivot said hook on said crosspin.

* * * * *